United States Patent [19]

Sinclair

[11] 3,968,544

[45] July 13, 1976

[54] TIE CLASP

[76] Inventor: James A. Sinclair, 4609 Creekbend St., Houston, Tex. 77035

[22] Filed: Mar. 19, 1975

[21] Appl. No.: 559,685

[52] U.S. Cl. ..... 24/49 CF
[51] Int. Cl.[2] ..... A41D 25/00
[58] Field of Search ..... 24/49 CP, 49 CF, 49 CC, 24/49 P, 85 A, 85 C, 86 A, 87 C, 159, 161 R, 86 C

[56] References Cited

UNITED STATES PATENTS

| | | | |
|---|---|---|---|
| 374,898 | 12/1887 | Huoncker | 24/159 X |
| 404,003 | 5/1889 | Herbert et al. | 24/159 |
| 513,563 | 1/1894 | Frisen | 24/159 |
| 1,413,131 | 4/1922 | Potter | 24/49 CP UX |
| 2,044,311 | 6/1936 | Krohmer | 24/49 CF |
| 2,065,831 | 12/1936 | Smith | 24/85 A |
| 2,181,443 | 11/1939 | Zeman | 24/49 CF |
| 2,406,400 | 8/1946 | Pumps | 24/49 CF |
| 2,510,286 | 6/1950 | Johnson | 24/49 CF |
| 3,494,003 | 2/1970 | Bower | 24/49 P |

FOREIGN PATENTS OR APPLICATIONS

| | | | |
|---|---|---|---|
| 18,606 | 8/1913 | United Kingdom | 24/159 |

*Primary Examiner*—Donald A. Griffin
*Attorney, Agent, or Firm*—Roy H. Smith, Jr.

[57] ABSTRACT

A tie clasp shaped generally like a safety pin and having a shirt link attached to its fixed back member. The novelty lies in so proportioning the clasp that it can be used to receive either the back pendant portion or both pendant portions of a four-in-hand necktie. When used only to receive the back pendant, the clasp is preferably made long enough to receive the usually relatively narrow rear pendant but not so long that it extends to either side of the usually rather broad front pendant, thus making the clasp invisible to an observer facing the wearer. Also when so used, the tie clasp has a forward member with a pointed free end, this member being movable between a closed position and an open position, and while open it is thrust into and then out of the rear fold of the front pendant without going completely through the thickness of the tie, thus securing both pendants while at the same time remaining invisible.

In an optional form and use, the tie clasp is elongated to receive both pendants of the necktie in free hanging position. The short chain and crossbar of the shirt link keep the tie firmly anchored to the shirt front, and the front member of the tie clasp may be embellished with a jewel, monogram or other ornamentation. The front member may be pivotable between open and closed positions, or it may be made fixed, so that the main part of the clasp or band is simply a closed loop, defining an opening which is elongated in one direction and narrow in the other.

4 Claims, 6 Drawing Figures

TIE CLASP

FIELD OF INVENTION

The present invention is a tie clasp or device used to secure a necktie of the four-in-hand type to the shirt of a wearer, and also includes both uses of the device and its combinations with neckties. A four-in-hand necktie is a single length of fabric which is passed under the user's shirt collar and knotted so that two portions of nearly equal length are pendant from the knot and drape down over the wearer's shirt front, covering the buttons and buttonholes of the shirt. Typically, the front pendant is relatively broad while the rearward or back pendant is relatively narrow, and the front pendant hangs a little lower than the back one.

PRIOR ART

Many types of tie clasps, tie pins and tie-tacs have heretofore been known, both in the patented art and otherwise. These have taken a wide variety of forms, but for the most part they are designed and adapted for use only with a part of the necktie-securing device displayed in front of the necktie, visible for all to behold; such devices cannot be completely concealed. While such devices may operate as intended, there are those users who would prefer a completely concealed device.

Other prior art devices are overly complicated in design, requiring a number of intricate parts. Another type attaches to a shirt button, and will weaken the means used to sew the button to the user's shirt, ultimately causing the button to loosen and fall off. The tie-tac type of device has the disadvantage of requiring at least two different parts, parts which have a peculiar propensity to become accidentally separated, the part fitting over the pointed spike being especially likely to being lost.

The prior art also includes the United States Patent issued to Bower, U.S. Pat. No. 3,494,003. While Bower in his last-numbered figure also shows a tie clasp which is somewhat similar to a safety pin, in his specification he teaches only the time-honored method using his invention when fastening two pieces of cloth together, i.e., pushing the pointed member through both bits of cloth and back out of the same before securing the pointed end in its latch or receiver; he teaches nothing about dimensioning his clasp so that it would be suitable for the purposes accomplished by applicant's tie clasps. Furthermore Bower discloses a tie clasp in which the pointed end of a movable member is left protruding at all times, with the consequent risk of snagging the fabric, and also the skin of the user. Additionally, he is completely silent about optional shapes and uses of a tie clasp as taught by applicant.

OBJECTS OF THE INVENTION

The present invention has as its principal object a tie clasp overcoming the disadvantages of such prior art devices, including among such disadvantages the exposure of a sharpened point. One specific object is a tie clasp holding one of the pendant portions of a four-in-hand necktie without any part of the tie clasp passing through such portion of the pendant. Another specific object is a tie clasp adapted for use so that it is totally concealed. Another object is to furnish such a tie clasp which is secured to the user's shirt without weakening the means used to secure any bottons to the shirt. A further object is to provide a tie clasp of unitary construction, having no separable parts. An additional object is to provide a tie clasp of simple design, one that is easy to fabricate and assemble. Yet another object is to provide such a tie clasp, a method of using the clasp, and a necktie-tie clasp combination in which no part of the tie clasp passes completely through any part of the necktie.

SHORT DESCRIPTION OF THE INVENTION

The preferred form of the tie clasp of the present invention is one in which the principal portion is a pair of wire-like members elongated across the width of a necktie of the four-in-hand type. The clasp has a closed position in which the two members are generally parallel and co-extensive, being secured to common members at their paired ends. At one pair of ends the front and back members are joined to a helical spring which urges the front member, when released, toward an open, non-parallel position relative to the back member. The opposed end of the front member is sharpened to a point suitable for ready penetration into the fabric of a necktie.

The opposed end of the back member is fixedly secured to a fixed latch consisting primarily of a semi-circular wire member which is co-planar with the back member and the opening of which faces toward the spring member. One end of this semicircle is secured to the back member while the other end includes an extension which is bent sideways to form an eye or pocket to receive the pointed end of the front member.

This extension is preferably continued to form a guide member disposed adjacent the semi-circular latch member in coaxial relationship. The latch and guide are also preferably bent away from the back member in such manner that the pocket which receives the pointed tip of the front member shields the tip against inadvertent contact with matter outside the clasp. The circular guide is so disposed that the pointed tip may be brought into contact with the guide and thereafter released, the guide member restricting the path of the tip so that it must enter the protective pocket.

The back member also includes an integral loop disposed about midway along its length, and to this loop is connected one end of the chain of a skirt link. The other end of this chain is pivotally connected to a crossbar adapted to be pushed lengthwise through the buttonhole of a shirt, then turned athwart the buttonhole to straddle the same and thus anchor the clasp to the shirt.

The preferred use of the clasp is by pushing the pointed front member through the rear fold of the broad or forward pendant of a necktie and out again through the same surface, taking care not to penetrate the front surface of the tie. The pin is closed, and either before or after such closing the narrow or rear pendant of the necktie is dropped through the generally rectangular space defined by the pin in closed position (the front and back members joined at their ends by the spring and latch). The pin may thus be completely concealed, although both pendants of the tie may be dropped through the rectangular opening of the clasp, if desired.

An alternate combination of tie clasp and necktie was inspired by the fact that necktie distributors frequently have a label secured to the rear folds of the broad front pendant of the necktie. Such label is nearly always sew to the necktie fabric so that either the label alone or the label and necktie together form a closed loop. The pointed-end front member of the tie clasp may be passed through this loop prior to closing the clasp, thus avoiding the need to pierce any fabric. Of course, in this combination the front member need not be sharpened to a point, and in fact may be as blunt as desired.

Many such labels are secured to the necktie with vertical stitching at the ends of the label, so that the loop itself may be said to have a vertical axis. While the tie clasps as above described will work well with labels thus disposed, the present invention also contemplates the improvement of securing the label or a securing strip to the necktie so that the loop thus formed is horizontally disposed; if the strip is elongated in one dimension, that dimension will extend vertically and the end stitching to the necktie will be horizontal. To accommodate neckties that have reached the market with labels extending horizontally, as securing strips may be provided with the tie clasp, to be horizontally secured to the back of the broad pendant by any convenient means. To avoid the necessity of a sewing operation, each strip may be provided with end portions coated with a strong pressure-sensitive adhesive, together with plastic pull covers which are removed from the adhesive just before attaching the securing strip to the necktie.

Another modified form of the invention utilize a tie clasp generally as above described, but with two modifications. One of these is to enlarge the dimensions of the tie clasp so that the space within it is large enough to accommodate both the rear and front pendants of the necktie, preferably in free-hanging position. With such dimensioning it is not essential that the tie clasp have both open and closed positions, and the second modifications is the alternate one of making the loop a permanently closed member, giving up the convenience of an openable clasp for simplified fabrication. This alternate form of tie clasp is, of course, visible to a person facing the wearer, but is a form preferred by some wearers. The front member may be provided with any of a number of types or ornaments such as jewels, lodge pins, and the like.

SHORT DESCRIPTION OF THE DRAWING FIGURES

The invention will become clearer to the reader by scrutinizing the enclosed drawing while he is considering the following description. In the drawing.

DETAILED DESCRIPTION OF THE DRAWING AND INVENTION

Figure 1:
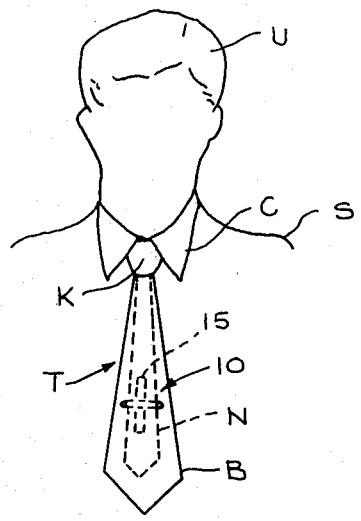
FIG. 1 is a front view of an adult male wearing a preferred embodiment of the tie clasp of the present invention with his necktie and shirt, the tie clasp being shown in phantom to indicate that it is concealed by the broad front pendant of the necktie.

FIG. 1 shows a wearer or user U wearing concealed. shirt S having a collar C with the indicated opening in the front. He is also wearing a necktie T which passes under and around collar C and is knotted at K so that the broad pendant portion B drapes down over his centrally located buttons and buttonholes (not shown) while the narrow pendant N hangs down behind pendant B, in concealed position. Secured to necktie N and one of the buttonholes of shirt S is a preferred embodiment 10 of the tie clasps of the present invention. It will be noted that the tie clasp 10 is completely cancelled. Tie clasp 10 is secured to necktie T more or less in the manner indicated in FIG. 5, with the narrow pendant N passing through the space 25 within the clasp, while the front member 50 of the clasp passes through the label or securing strip 15. In the FIG. 1 embodiment, the strip 15 is disposed vertically, and is secured at its ends to the back surface of the broad pendant B.

Figure 2:
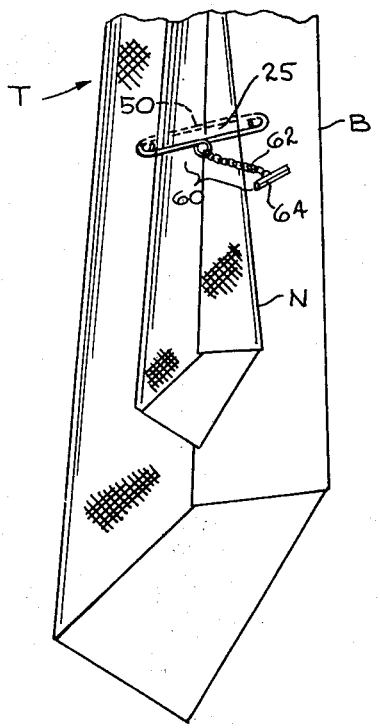
FIG. 2 is a rear view of a necktie and tie clasp as isolated from the wearer and his shirt.

A preferred manner of using the tie clasp 10 is shown to better advantage in FIG. 2, where necktie T has been removed from the wearer and rotated 180 degrees, together with tie clasp 10. As illustrated, the clasp 10 has two original and integrally joined parts or subassemblies, the pin portion 11 and shirt link 60, the latter comprising the short chain 62 and crossbar 64. The pin portion forms a generally rectangular loop defining a rectangular space 25 which receives narrow pendant N, and a member 50 of the pin 11 penetrates through the back fold or fabric of broad pendant B without passing through the front surface of B. The crossbar 64 is inserted lengthwise in a buttonhole and then turned sideways to straddle the hole, in the usual fashion.

Figure 3:
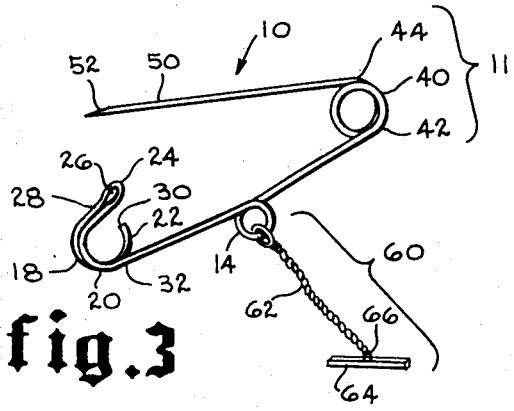
FIG. 3 is a perspective view of the same tie clasp as removed from any necktie, in open position.
Figure 4:
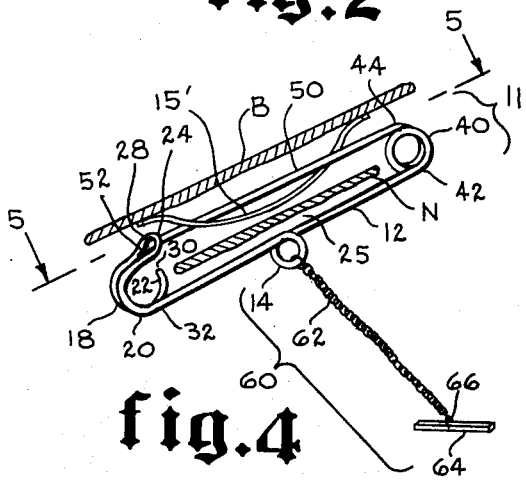
FIG. 4 is the same perspective view of the same tie clasp, this view also showing the front member of the tie clasp extending through a label or securing strip secured to the back of the broad pendant of the necktie, and showing the narrow pendant received within the loop formed by the tie clasp.
Figure 5:
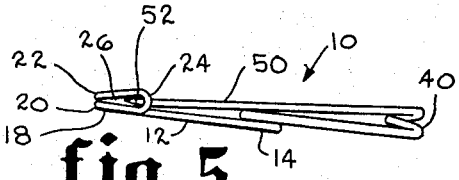
FIG. 5 is an edge view of the same tie clasp, as indicated by the lines and arrows labeled 5—5 in FIG. 4 without the shirt link.

The same tie clasp is shown in greater detail in FIGS. 3, 4 and 5, which illustrate the tie clasp 10 isolated from any necktie. The main or pin portion 11 preferably is made of a continuous length of resilient metal wire, having as its principal parts the front member 50, pointed at its free end 52, the helical spring 40, back member 12 and the latch 18. In addition to other functions, spring 40 and latch 18 serve to space members 12 and 18 apart from one another and to join them in such spaced relationship. As best seen in the closed position of FIG. 4, front member 50 is essentially parallel to back member 12 when the clasp is closed, and this pair of members together with spring 40 and latch 18 define a generally rectangular space 25 which receives the narrow pendant N of a necktie T. As indicated in this figure, the broad pendant B may be secured to the tie clasp 11 by running front member 50 through the label 15′ secured to the back of pendant B prior to closing the clasp, even through label 15′ may run horizontally. In such combination it is of course unnecessary for end 52 of the pivotal member 50 to be anything but blunt.

The spring 40 may be even simpler than the 1½ turn, essentially flat helix shown in the drawing, i.e., it may be nothing than a half turn. When the portion is formed of the same continuous wire, spring 40 is joined to front member 50 at 44, and to back member 12 at 42. As indicated in the open or free position of the clasp shown in FIG. 3, spring 40 biases front member 50 to a cocked position relative to back member 12. In the closed position shown in FIG. 4, spring 40 continues to exert a clockwise moment on front member 50, assuring that the tip 52 will stay engaged in latch 18. It will continue so engaged until the user exerts a downward force on member 50 to disengage tip 52, and then moves member 50 slightly to the side of the latch so that it can spring up to the released position of FIG. 3.

In its simplest form, latch 18 consists of a semi-circular or half loop 20, plus a small extension bent sideways at 24 and returned parallel to the half loop to form a pocket or eye 26. The half loop 20 is disposed so that its open part faces toward spring 40, one end joins back member 12 tangentially at 32, and it is co-planar with the back loop. In diameter it is essentially equal to spring 40, and its end not secured to the back member is thus spaced from back member 12 about the same distance as the joint 44 where front member 50 joins spring 40.

Since something further is needed to form a catch or stop for the end 52 of front member 50, the half loop 20 has an integral extension which is bent back upon itself at 24, returning parallel to and slightly spaced from the semi-circle 20 to define an eye or pocket 26 which receives tip 52 of front member 50 in releasable locked engagement.

What has been described thus far are the only essential structural components of latch 18, but two optional refinements are illustrated which make the tie clasp more useful and valuable. One of these comprises an upward bend in the free end of latch 18, part 28 as shown in the drawing. This has the added contribution that pointed tip 52 is received in an upturned pocket 28 in such manner that it is completely shielded or protected against inadvertent contact with any cloth or other outside matter. A user can brush his fingers in all manners over the assembly, and from all angles, without contacting the pointed tip 52.

The other refinement is to extend the bent-around portion of half loop 20 to form a guide 22 for movement of tip 52. The preferred form of guide is a circular loop returning to upturned portion or pocket 26, as illustrated, the gap 30 being too small to permit tip 50 from passing through laterally. Although the guide could take the form of a chord from eye 26 to the lower portion of half loop 20 near its juncture 32 with back member 12, the preferred form of guide is the circular loop illustrated and described, in which event it is of the same diameter as half loop 20, and is co-axial and side-by-side therewith.

Finally, the tie clasp 10 includes the shirt link 60, consisting of short chain 62 having crossbar 64 pivotally secured to one end thereof. The other end of chain 62 is secured in slidable fashion to the loop 14 formed in back member 12 at about its midlength. In the usual manner, link 60 is removably secured to a shirt by thrusting the crossbar 64 lengthwise through a buttonhole of a shirt, then turning it to sit athwart of the buttonhole to catch on the shirt material on each side of the buttonhole.

Figure 6:
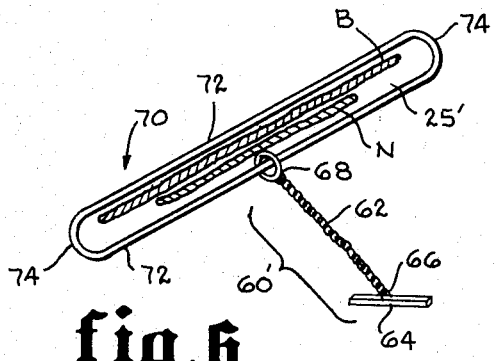
FIG. 6 is a perspective view of a tie clasp made large enough to accommodate both pendant portions of a necktie.

The alternate embodiment illustrated in FIG. 6 comprises a simple closed loop 70 defining a generally rectangular space 25' which is long enough and wide enough to accommodate both the broad pendant B and narrow pendant N of the necktie, as illustrated. While loop 70 may be formed in various ways, e.g., may itself be a chain, in the illustrated form it is a rigid member having a pair of parallel front and back members 72 secured together by the pair of end members 74. There is no necessity for having the front member pivotal, as in the prior embodiments, because it does not have to pierce or pass through anything; it may, however, be made in this fashion for the benefit of those who find it more convenient to open and close a clasp than to thread and unthread the pendants of a necktie through a rigid loop.

A minor variation introduced with FIG. 6 embodiment is the substitution of a sliding loop 68 for the fixed loop 14 of FIG. 4 which is integral with back member 12 of that loop. Either method of securing the chain 60 (or 60') to the back member is satisfactory, so long as it secures chain 62 to the loop of the tie clasp.

It will be apparent, of course, that the type of tie clasp shown in FIG. 4 can be used for the same purpose as that shown in FIG. 6, i.e., to receive both pendants of a necktie, by making the former long enough and wide enough to receive both pendants without crumpling them. When so modified and still preserving the pivotal nature of front member 50 and furnishing a latch to receive its end 52, such end need not be pointed or sharpened.

It will now be appreciated the foregoing disclosure provides a tie clasp which in one form meets the wearer's desire that the clasp be completely concealed, and yet is of simple onepiece design, with no separable parts to get lost. In this form the tie clasp does not pass completely through any part of the necktie, as it simply surrounds the back pendant and is passed through only the rearward folds of the front pendant as opposed to a prior art patentee's teaching of only a use wherein the tie clasp pierces and passes completely through the back pendant. It also provides a construction in which the sharpened tip of the piercing member of the clasp is received in a latch so that, during the wearing of the clasp, the necktie and the skin of the wearer are protected against inadvertent pricking by such sharp tip.

The disclosure teaches a new way of combining a tie clasp with a necktie, by using the space defined by the loop of the clasp to receive at least the back pendant of the necktie, in contrast to the prior art teaching of passing the pointed part of the clasp through the rear pendant, in the conventional manner of using a safety pin. Also disclosed are new ways of combining tie clasp with the label commonly secured to the back surface of the broad pendant to eliminate all piercing operations, or adding a strip of the necktie for this particular purpose. Finally, the disclosure teaches an elongated tie clasp in the form of a unitary loop with such dimensions that it will receive both loops of a necktie, with or without the articulation of a part of the loop in the manner of a clasp.

What is claimed is:

1. A tie clasp comprising a loop-forming member having a closed position defining a generally rectangular space having a relatively long dimension and a relatively short dimension, said loop including a pair of end members and a pair of parallel front and back members extending between and secured to said end members, and a shirt link connected to said back member between the ends thereof, said loop-forming member in closed position being free of sharp projecting points, said long and short dimensions being selectively chosen to accommodate therein the back pendant of a four-in-hand necktie in free hanging position, one of said end members being a spring while the other is a latch, said front member being pivotally secured to and actuated by said spring at one of its ends, the other or free end of said front member being pointed and releasably received in said latch in the closed position of said loop-forming member, said loop forming member also having an open position in which the front member is free from said latch and extends at an angle to the back member, and may be inserted either through the front or broad pendant of said necktie or through a label or securing strip secured at its ends to the back face of said broad pendant and thereafter returned to the closed position, said long dimension being shorter than the width of the broad pendant of the necktie to keep said tie clasp concealed, said latch being bent to define an eye receiving said pointed end of the front member to shield said point from contact with cloth and other extraneous material, said latch being formed of a pair of legs which converge together away from said eye, one of said legs being joined to the back member while the other terminates in a free-ended arcuate portion slightly spaced from said eye and serving to guide said pointed end of the front into said eye.

2. In combination, a necktie and a tie clasp designed to secure the necktie to a wearer's shirt front, said necktie being of the elongated type adapted to be passed through the wearer's shirt collar and knotted at the front so that there are two pendant portions draping down over the center of the wearer's shirt, one said pendant portion being in front and the other in back, said tie clasp comprising elongated front and back members, a spring member, a latch, and a shirt link connected to said back member between the ends thereof, said back member extending between and having its respective ends secured to said spring and latch, said front member having one end free and pointed while the other is secured to said spring so that the spring biases the front member to an open position, at an angle with respect to the back member, said front member being rotatable to a closed position against the tension of the spring, in which closed position the pointed end of the front member is releasably secured by said latch, said front member passing either through the rearward fold of the front pendant portion of the necktie or between said portion and a loop or label secured thereto and into said closed position, said spring and latch together with the front and back members in closed position defining a loop receiving the back pendant portion of the necktie in free hanging position, said latch comprising a pair of semi-circular legs joined together at one set of ends to form an eye and then converging to a side-by-side relationship to form a trap for said pointed end of the front member, one semi-circular leg having its other end joined to said back member while the companion leg is extended back toward said eye and terminates slightly spaced therefrom to form a guide for the pointed end of the front member in closing the tie clasp.

3. In combination, a four-in-hand necktie and a tie clasp comprising a loop member having a pair of parallel front and back members secured together by a spring at one pair of ends and a latch at the other, said front member being pivotally secured to said spring and manually releasable from said latch to assume an open, cocked position relative to the back member, the free end of said front member being blunt and unsharpened so that it may be passed between the back surface of the front pendant of a four-in-hand necktie and a label or securing strip secured on said back surface before being returned to its closed position, in engagement with said latch, and a shirt link connected to the back member between the ends thereof, said loop being of a size to receive the back pendant of the necktie while being concealed behind the front pendant, said four-in-hand necktie having a label secured to the rear surface of the front pendant of the necktie in such manner that there is room to pass a small object between the label and said back surface, said tie clasp being disposed so that it receives the back pendant and its front member passes under said label.

4. A tie clasp formed of a single piece of wire comprising a first end which is pointed and constitutes the free end of an elongated front member pivotal between closed and open positions and having its other end secured to a spring formed by wrapping said single piece of wire into a circular loop of at least one and a half turns and thereafter forming said piece of wire into a back member extending parallel to said front member beyond the pointed end thereof, said back member having a loop formed at about its midlength adapted to receive one end of a chain whose opposite end is secured to a buttonhole engaging bar, said single piece of wire thereafter being bent to form a clasp having the form of generally semi-circular loop the opening of which faces toward the spring end of the clasp, a second loop formed by bending the wire back upon itself to form a pair of converging leg portions which have a juncture forming an eye disposed to receive and trap the pointed end of the front member in locking and shielding position and a guiding portion formed by continuing said second loop parallel to the first but terminating above said back member to form a guide to direct said pointed end of the front member into the eye when closing the clasp.

* * * * *

UNITED STATES PATENT OFFICE

CERTIFICATE OF CORRECTION

Patent No. 3,968,544 Dated July 13, 1976

Inventor(s) James A. Sinclair

It is certified that error appears in the above-identified patent and that said Letters Patent are hereby corrected as shown below:

Column 3, line 1, "sew" should read -- sewn --.

Column 4, line 7, "concealed" should read -- a --.

Column 4, line 17, "cancelled" should read -- concealed --.

Column 6, line 25, "onepiece" should read -- one-piece --.

Signed and Sealed this

Ninth Day of November 1976

[SEAL]

*Attest:*

RUTH C. MASON
*Attesting Officer*

C. MARSHALL DANN
*Commissioner of Patents and Trademarks*